US007946214B2

(12) United States Patent
Stone

(10) Patent No.: US 7,946,214 B2
(45) Date of Patent: May 24, 2011

(54) GAS SYSTEM FOR FIREARMS

(75) Inventor: Jeffrey W. Stone, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 223 days.

(21) Appl. No.: 12/199,172

(22) Filed: Aug. 27, 2008

(65) Prior Publication Data

US 2010/0282065 A1 Nov. 11, 2010

Related U.S. Application Data

(60) Provisional application No. 60/968,733, filed on Aug. 29, 2007.

(51) Int. Cl.
*F41A 5/18* (2006.01)

(52) U.S. Cl. ..... 89/193

(58) Field of Classification Search ..... 89/192–194, 89/191.01, 191.02
See application file for complete search history.

(56) References Cited

U.S. PATENT DOCUMENTS

| | | | | |
|---|---|---|---|---|
| 1,996,124 | A | 4/1935 | Rowley | |
| 2,093,706 | A | 9/1937 | Browning | |
| 2,186,582 | A | 1/1940 | Gebauer | |
| 2,456,290 | A | 12/1948 | Ljutic | |
| 2,554,618 | A | 5/1951 | Dixon | |
| 2,582,989 | A | 1/1952 | Harvey | |
| 2,637,247 | A | 5/1953 | Hester | |
| 2,777,366 | A | 1/1957 | Cook | |
| 2,887,013 | A * | 5/1959 | Marsh | 89/193 |
| 2,918,847 | A * | 12/1959 | Barr | 89/125 |
| 2,918,848 | A * | 12/1959 | Maillard | 89/193 |
| 2,983,196 | A * | 5/1961 | Dixon | 89/33.25 |
| 2,987,968 | A | 6/1961 | Janson | |
| 3,125,930 | A | 3/1964 | Gilbert | |
| 3,166,983 | A * | 1/1965 | Lizza | 89/191.01 |
| 3,207,036 | A * | 9/1965 | Norton | 89/191.01 |
| 3,306,168 | A | 2/1967 | Blumrick | |
| 3,443,477 | A | 5/1969 | Kaempf | |

(Continued)

FOREIGN PATENT DOCUMENTS

DE 41 36 665 A1 5/1993

(Continued)

OTHER PUBLICATIONS

International Search Report for related Application No. PCT/US2007/012364, mailed Oct. 27, 3008.

(Continued)

*Primary Examiner* — Bret Hayes
*Assistant Examiner* — Reginald Tillman, Jr.
(74) *Attorney, Agent, or Firm* — McGuuire Woods, LLP

(57) ABSTRACT

A piston assembly is provided for a gas-operated firearm of the type having a chamber and a barrel. The piston assembly includes a gas expansion housing and a piston mounted within the gas expansion housing. An annular recess is formed in the outer wall of the piston to receive exhaust gases diverted from the barrel upon firing of the firearm. At least one longitudinally extending groove extends from the annual recess to the head of the piston and forms a pathway for diverting the exhaust gases to the head of the piston. During firing, pressurized gases are diverted into the annular recess and expand longitudinally from the annular recess to the piston head, whereupon the pressurized exhaust gas drives the gas piston rearwardly along the housing.

20 Claims, 7 Drawing Sheets

U.S. PATENT DOCUMENTS 3,444,641 A 5/1969 Ruger
3,568,564 A 3/1971 Baldi
3,592,101 A 7/1971 Vartanian et al.
3,601,002 A 8/1971 Janson
3,680,434 A 8/1972 Muhlemann
3,690,219 A * 9/1972 Muhlemann et al. ..... 89/193
3,707,110 A * 12/1972 Alday ..... 89/193
3,709,092 A 1/1973 Tazome
3,776,096 A 12/1973 Donovan
3,810,412 A 5/1974 Zamacola
3,945,296 A 3/1976 Hyytinen
3,988,964 A 11/1976 Moore
3,990,348 A 11/1976 Vesamaa
3,999,534 A 12/1976 Chapin et al.
4,014,247 A 3/1977 Tollinger
4,015,512 A 4/1977 Feerick
4,058,922 A 11/1977 Elbe et al.
4,085,654 A 4/1978 Panigoni
4,102,242 A 7/1978 Liedke
4,109,558 A 8/1978 Panigoni
4,125,054 A * 11/1978 Jennie ..... 89/193
4,126,077 A 11/1978 Quesnel
4,373,423 A 2/1983 Moore
4,389,920 A 6/1983 Dufour, Sr.
4,395,838 A 8/1983 Civolani
4,409,883 A 10/1983 Nyst
4,414,880 A 11/1983 Throner et al.
4,475,438 A 10/1984 Sullivan
4,505,183 A 3/1985 Grehl
4,538,502 A 9/1985 Benelli
4,563,937 A 1/1986 White
4,599,934 A 7/1986 Palmer
4,604,942 A 8/1986 Benelli
4,702,146 A 10/1987 Ikeda et al.
4,709,617 A 12/1987 Anderson
4,765,224 A 8/1988 Morris
4,872,392 A 10/1989 Powers et al.
4,901,623 A 2/1990 Lee
5,173,564 A 12/1992 Hammond, Jr.
5,218,163 A 6/1993 Dabrowski
5,272,956 A 12/1993 Hudson
5,274,939 A 1/1994 Scaramucci et al.
5,279,202 A 1/1994 Bellardi et al.
5,287,642 A 2/1994 Scaramucci
5,351,598 A 10/1994 Schuetz
5,404,790 A 4/1995 Averbukh
5,448,940 A 9/1995 Schuetz et al.
5,499,569 A 3/1996 Schuetz
5,520,019 A 5/1996 Schuetz
5,726,377 A 3/1998 Harris et al.
5,737,865 A 4/1998 Brandl et al.
5,767,434 A 6/1998 Hirtl et al.
5,824,943 A 10/1998 Guhring et al.
5,827,992 A 10/1998 Harris et al.
5,872,323 A 2/1999 Norton et al.
5,937,558 A 8/1999 Gerard
5,939,659 A 8/1999 Dobbins
5,959,234 A 9/1999 Scaramucci
5,983,549 A 11/1999 Battaglia
6,029,645 A 2/2000 Wonisch et al.
6,243,978 B1 6/2001 Vignaroli et al.
6,374,528 B1 4/2002 Davis et al.
6,374,720 B1 4/2002 Tedde
6,382,073 B1 5/2002 Beretta
6,508,160 B2 1/2003 Beretta
6,619,592 B2 9/2003 Vignaroli et al.
6,662,485 B2 12/2003 Kay
6,834,455 B2 12/2004 Burigana
6,886,286 B2 5/2005 Dowding
6,889,461 B2 5/2005 Vignaroli et al.
6,971,202 B2 12/2005 Bender
7,162,822 B1 1/2007 Heayn et al.
7,162,823 B2 1/2007 Schoppman et al.
7,252,138 B2 8/2007 Burkhalter et al.
7,311,032 B2 12/2007 Murello
7,343,844 B2 3/2008 Poff, Jr.
7,448,307 B1 11/2008 Dafinov
7,461,581 B2 12/2008 Leitner-Wise
7,467,581 B2 12/2008 Botty
2001/0054350 A1 12/2001 Beretta
2002/0073832 A1 6/2002 Vignaroli et al.
2002/0096042 A1 7/2002 Adkins
2002/0139362 A1 10/2002 Shipachev et al.
2005/0016374 A1 1/2005 Pescini
2005/0223613 A1 10/2005 Bender
2005/0235817 A1 10/2005 Murello
2005/0257681 A1 11/2005 Keeney et al.
2005/0268516 A1 12/2005 Nelson
2006/0065112 A1 3/2006 Kuczynko et al.
2007/0012169 A1 1/2007 Gussalli

FOREIGN PATENT DOCUMENTS

EP 1 215 464 6/2002
EP 1 624 275 2/2006
FR 2 686 152 7/1993
GB 214505 A 4/1924
GB 1405189 9/1975
RU 2279028 C1 6/2006
WO WO 2008/108786 9/2008
WO WO 2009/061546 5/2009
WO WO-2010/151549(A1) 12/2010

OTHER PUBLICATIONS

Written Opinion for related Application No. PCT/US2007/012364, mailed Oct. 27, 2008.
International Search Report for corresponding PCT Application No. PCT/US2008/074601, mailed Jul. 21, 2009.
International Search Report for related PCT application No. PCT/US2010/039526, mailed Sep. 3, 2010.
Written Opinion for related PCT application No. PCT/US2010/039526, mailed Sep. 3, 2010.

* cited by examiner

GAS SYSTEM FOR FIREARMS

CROSS REFERENCE TO RELATED APPLICATIONS

This application claims the benefit of U.S. Provisional Application No. 60/968,733, entitled GAS SYSTEM FOR FIREARMS, filed Aug. 29, 2007, which application is incorporated herein by reference in its entirety.

FIELD OF THE INVENTION

The present invention generally relates to an assembly for directing expanding propellant gases from the chamber of a firearm to an expansion chamber housing a piston for semi-automatic firearms.

BACKGROUND OF THE INVENTION

Semi-automatic firearms, such as rifles and shotguns, are designed to fire a round of ammunition, such as a cartridge or shotshell, in response to each squeeze of the trigger of the firearm, and thereafter automatically load the next shell or cartridge from the firearm magazine into the chamber of the firearm. During firing, the primer of the round of ammunition ignites the propellant (powder) inside the round, producing an expanding column of high pressure gases within the chamber and barrel of the firearm. The force of this expanding gas propels the bullet/shot of the cartridge or shell down the barrel.

In semi-automatic rifles and shotguns, a portion of the expanding gases typically are directed through a duct or port that interconnects the barrel of the firearm to a piston assembly that generally houses an axially moveable piston. The portion of the explosive gases that are diverted from the barrel of the firearm act upon the piston so as to force the piston rearwardly to thus cause the rearward motion, or recoil of the bolt of the firearm. This rearward motion opens the chamber and ejects the empty shell or cartridge casing, and thereafter loads another shell or cartridge into the chamber, after which the bolt returns to a locked position for firing as the gases dissipate or are bled off.

Known gas actuating piston assemblies for semi-automatic firearms can suffer from numerous disadvantages, however, including the inability to regulate the gas energy being transmitted to the piston. For example, the pressure of the diverted gases is often unequally distributed against the gas piston, thereby causing uneven movement of the piston that can result in rapid deterioration and/or damage to the piston. Also, when lower power cartridges or shells are used, the pressure of the discharge gases sometimes is not sufficient to properly or fully actuate/drive the piston assembly, which can result in misfired or jammed shells or cartridges. Further, the inventor has discovered that there is a relationship between the magnitude of the pressure impulse delivered by the discharge gases and the distance from the chamber of the firearm to the gas piston.

It therefore can be seen that a need exists for firearm that addresses the foregoing and other related and unrelated problems in the art.

SUMMARY OF THE INVENTION

One embodiment of the present invention is directed to a gas redirecting piston assembly for a gas-operated firearm. Such a firearm typically will have a barrel, a chamber, a firing assembly or fire control including a trigger, and a bolt that is translatable between a loading position and a firing position behind a cartridge/shell to be fired.

In one embodiment, the gas redirecting piston assembly comprises a tubular gas expansion housing and a piston. The piston is slideably mounted within the tubular expansion housing and includes a first, open tubular end and a second, closed end or piston head. The open tubular end defines an inner bore that is dimensioned to receive a spring-loaded connecting rod. An annular recess is formed in the outer surface of the piston proximate the open tubular end. In one embodiment, the piston further includes an annular gas seal formed or applied at its open tubular end, with the annular recess generally being formed between the annular gas seal and the closed piston head. Multiple similarly formed and radially-spaced longitudinal groves extend along the body of the piston from the annular recess to the piston head to provide pathways for directing the combination gases necessary for driving the piston along the expansion housing.

A mechanical stop can be extended through the wall of the expansion housing for cooperatively engaging an elongated axial slot in the piston to thus limit the axial travel of the gas piston in the tubular housing. In other embodiments, the gas piston can be formed with a gas "shut-off" feature to limit the amount of gas diverted from the barrel through the gas ports to the piston. In another embodiment, the piston also can include a gas purge feature that evacuates the gas upon completion of a full stroke of the piston, thus reducing or eliminating the damping effect on the return stroke of the piston.

In operation, when the firearm is fired, pressurized exhaust gases in the chamber region are diverted through a duct or path located between the barrel and the tubular housing into the annular recess. The pressurized gas expands and travels along the spaced longitudinal grooves to the operating head of the gas piston, and forces the piston to move axially rearwardly along the housing. This axial movement compresses the spring and drives the connecting rod rearwardly to translate the breech bolt or bolt rearwardly and open the chamber for reloading. As the gas pressure dissipates and is evacuated, the force of the spring drives the connecting rod and piston forwardly into a pre-firing position, thus completing one firing cycle.

These and other features and aspects of the invention will become more apparent upon review of the detailed description set forth below when taken in conjunction with the accompanying drawing figures, which are briefly described as follows.

BRIEF DESCRIPTION OF THE DRAWINGS

The invention is better understood by reading the following detailed description of the invention in conjunction with the accompanying drawings.

DESCRIPTION OF THE INVENTION

Figure 1:
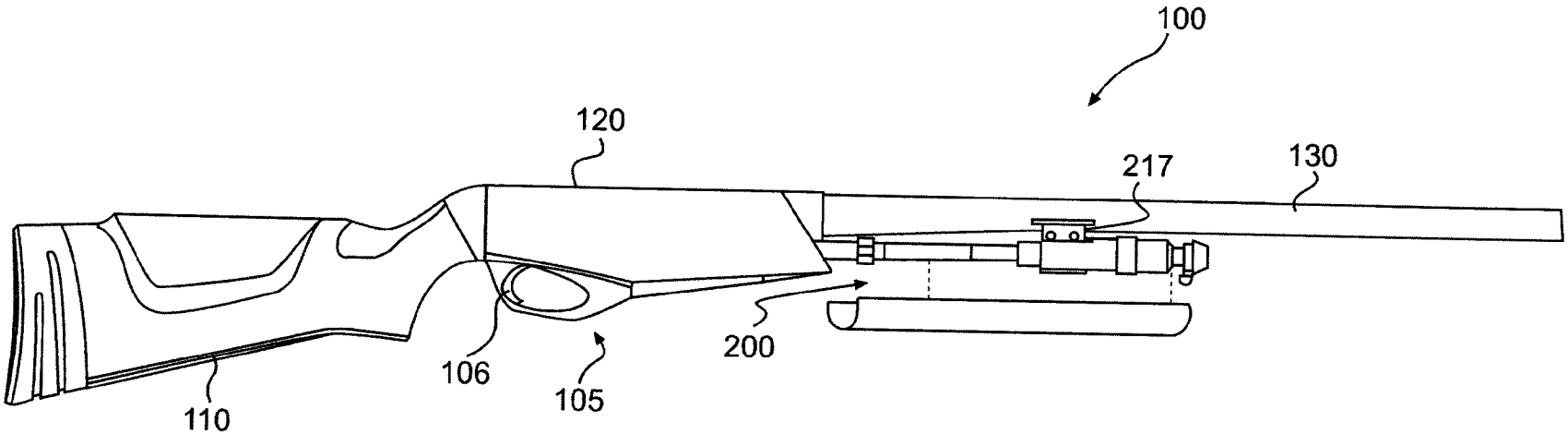
FIG. 1 illustrates a firearm with one exemplary embodiment of the gas redirecting piston assembly according to the principles of the present invention.
Figure 2:
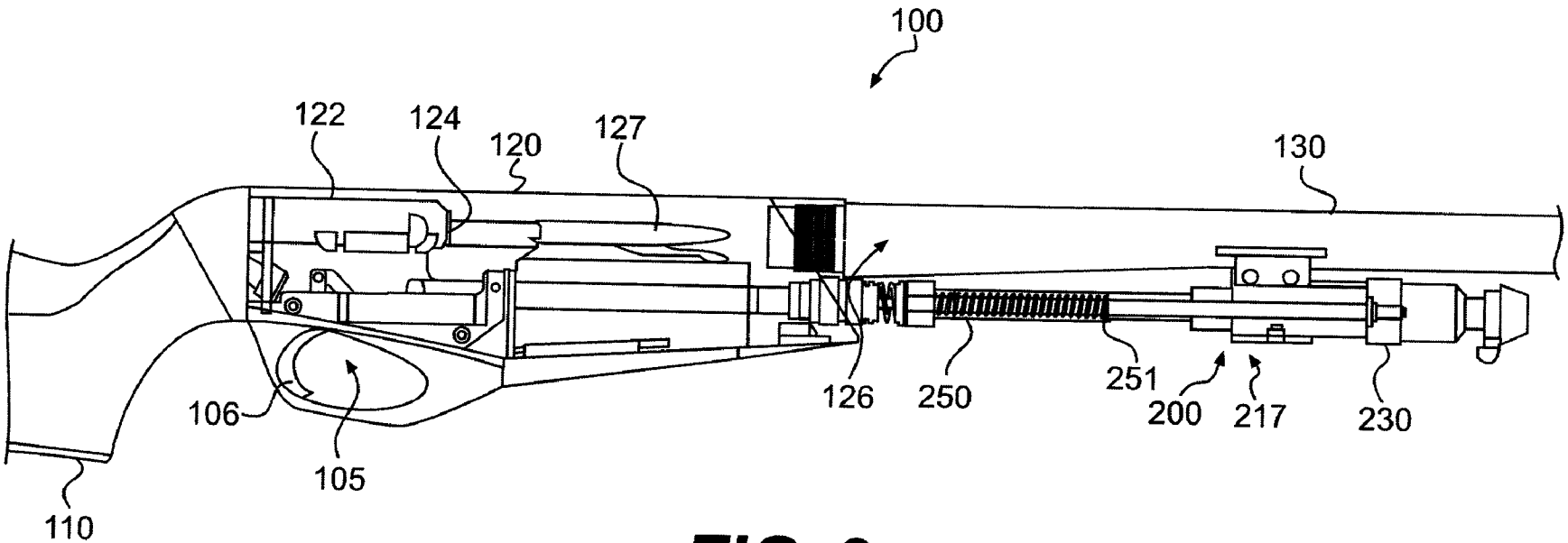
FIG. 2 is a cutaway view of the firing mechanism, chamber, barrel, and the gas redirecting piston assembly of the firearm of FIG. 1.

Referring now to the drawings in which like numerals indicated like parts throughout the several views, FIGS. 1 and 2 illustrate one example embodiment of the gas redirecting piston assembly according to the principles of the present invention for use in a firearm such as a rifle, although it will be understood that the gas redirecting piston assembly can be used in various types of firearms including shotguns and other long guns, hand guns and other gas operated firearms. Those skilled in the relevant art further will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

As shown in FIGS. 1 and 2, a firearm, here shown as a rifle 100, generally is illustrated. The firearm 100 generally comprises a fire control 105 including a trigger 106, a stock 110, a receiver 120, and a barrel 130. The stock 110, also known as the buttstock or shoulder stock, may be formed in any conventional manner to include cushioning, special curvatures, grips, etc. As shown in FIG. 2, the receiver 120 typically houses and includes the firing mechanism or fire control 105, a breech bolt or bolt assembly 122, and a firing pin 124. The bolt assembly 122 is axially translatable forwardly and rearwardly along the receiver during the firing cycle and generally is located behind a chamber portion 126 located at the proximal end of the barrel 130 adjacent the receiver. The chamber 126 receives a shell or cartridge 127 for firing as the bolt assembly is cycled and extends into the barrel 130 in open communication therewith.

In the gas-operated semi-automatic automatic firearm 100 illustrated in FIGS. 1 and 2, a gas-operated redirecting piston assembly 200 is provided for reloading the chamber after firing by way of mechanical interconnection and interaction between the gas redirecting piston assembly and the bolt 122. During a firing operation, the action of the gas piston, which in turn is translated to the bolt, functions to automatically clear or discharge a spent cartridge/shell casing from the chamber, load a new cartridge/shell into the chamber, and recock the firing pin and bolt for a next firing cycle.

Figure 3:
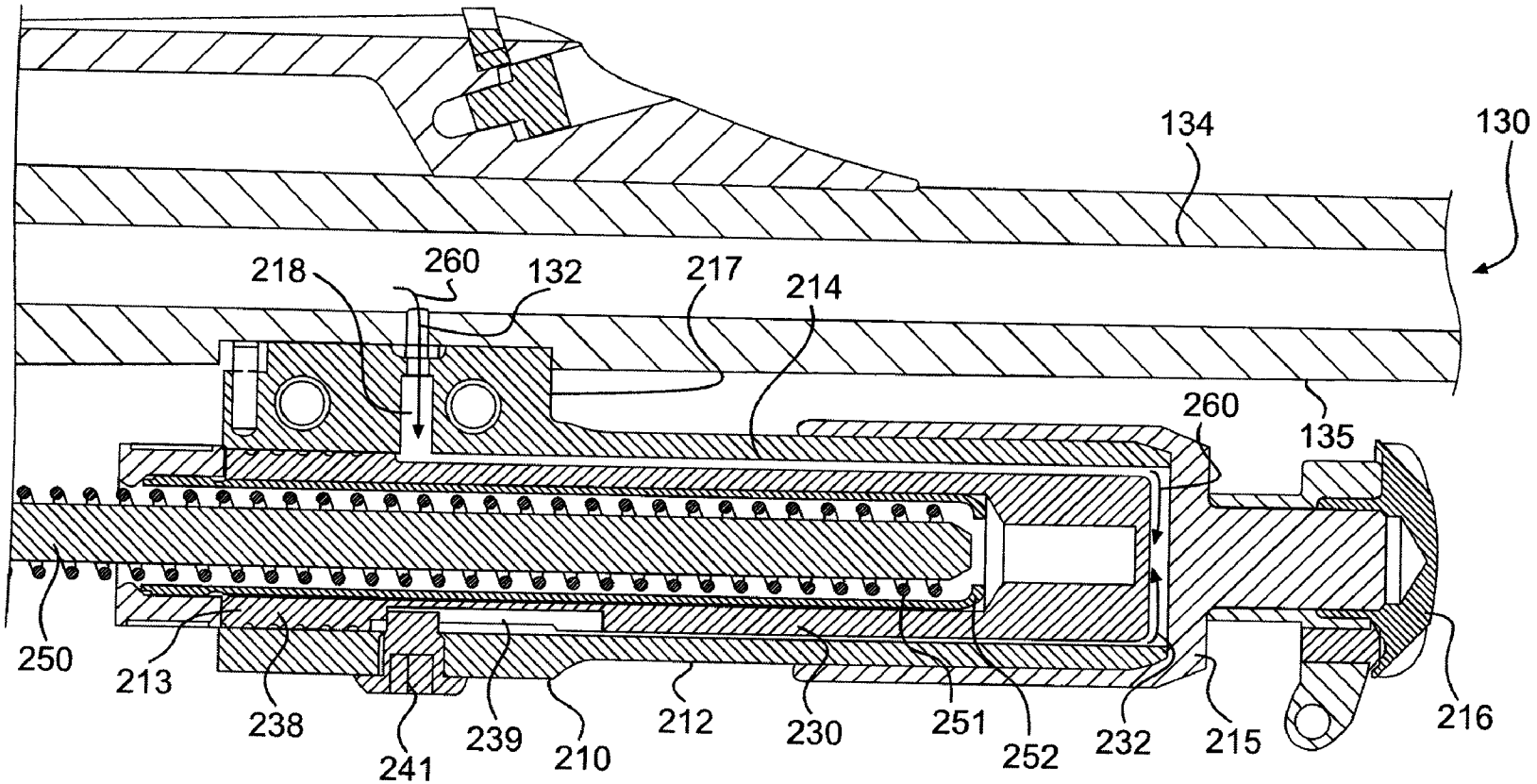
FIG. 3 is a cross-sectional view of one embodiment of the gas redirecting piston assembly of the present invention, illustrating the relative position of the piston before firing.
Figure 4:
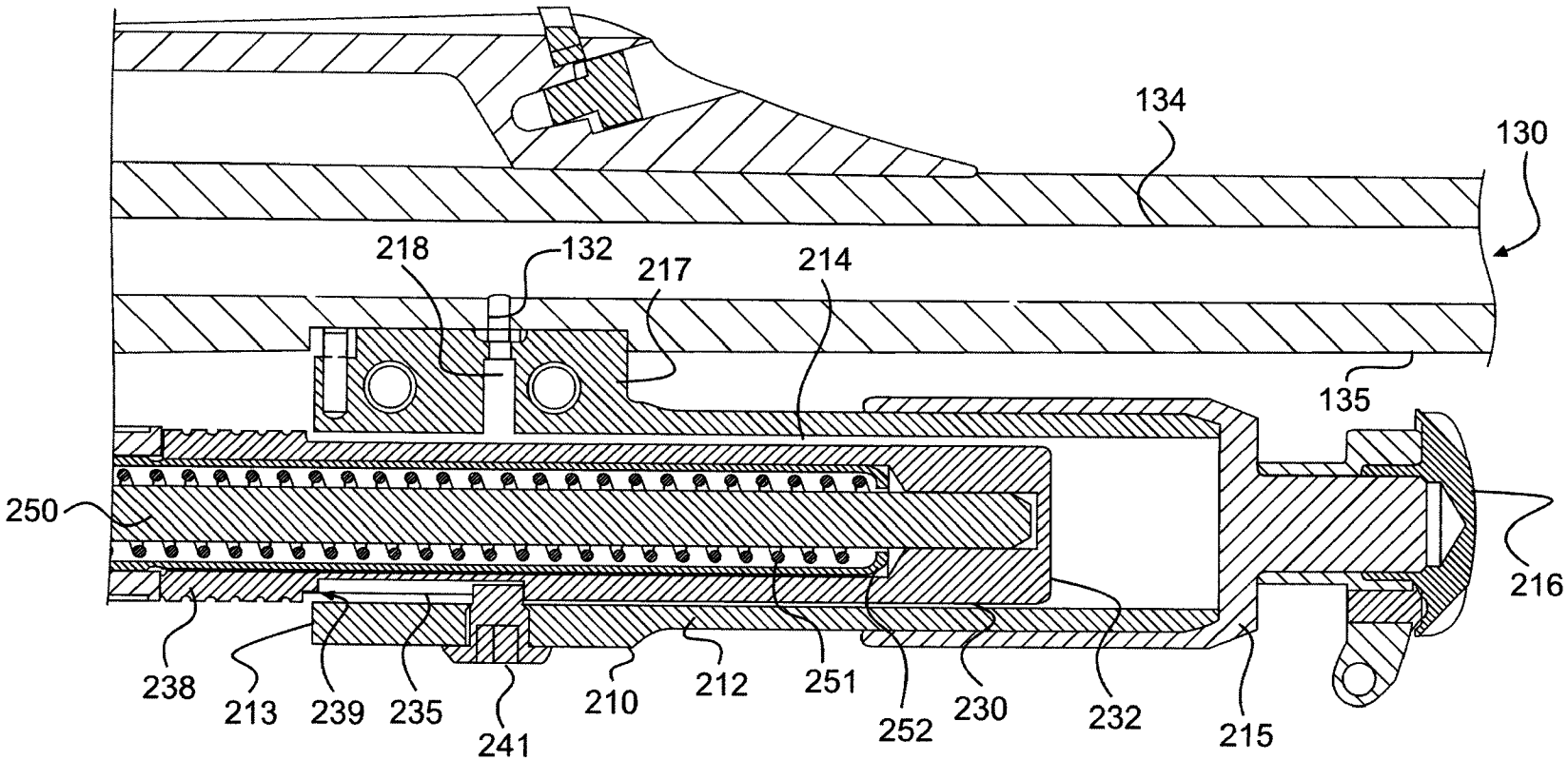
FIG. 4 is a cross-sectional view of one embodiment of the gas redirecting piston assembly of the present invention illustrating the relative position of the piston after firing.

As shown in FIGS. 3 and 4, in one example embodiment, the gas-redirecting piston assembly 200 according to the principles of the present invention comprises an elongated tubular gas expansion housing 210 with a gas piston 230 slideably mounted within the gas expansion housing 210. The tubular gas expansion housing 210 generally is formed as a substantially hollow cylinder having an outer cylindrical wall 212 and defines an inner bore 214 extending therealong. The first or rear end 213 of the housing 210 is open to receive the gas piston 230, while its second or forward end 215 can be enclosed by a sealing cap 216 or may be formed as a closed end defining a concave orifice at the end of the housing. As further indicated in FIGS. 1-4, mounting lug 217 generally supports the housing 210 and interconnects the housing 210 to the underside of the barrel 130 of the rifle. The mounting lug 217 may be either integrally formed with the gas expansion housing 210 or may be a separately formed component.

A gas port 218 extends through the mounting lug 217 into the gas expansion housing 210 to enable passage of exhaust gases generated during a firing operation, as indicated by arrow 260 in FIG. 3. The gas port 218 is located along the barrel adjacent and/or slightly downstream from the chamber so that when the mounting lug 217 and housing 210 are installed beneath the barrel 130, the gas port is aligned with and is located in fluid communication with a gas duct 132 that extends between the inner bore 134 of the barrel 130 and the outer side wall 135 of the barrel 130. The relative diameters of both the gas port 218 and the gas duct 132 generally can be selected based upon firearm type and/or the types of ammunition to be used.

As described in greater detail below, one or more additional apertures may be formed through the cylindrical wall of the housing for the insertion of mechanical bosses, or stops. FIG. 3 illustrates the relative position of the gas piston 230 within the housing 210 in one embodiment in preparation for firing, wherein the piston 230 is in a resting or retracted position within the housing 210, whereas FIG. 4 illustrates the relative position of the gas piston 230 within the housing 210 immediately after firing, with the piston 230 being shown in its engaged, operative position, having moved longitudinally toward the rear end of the housing 210.

Figure 5:
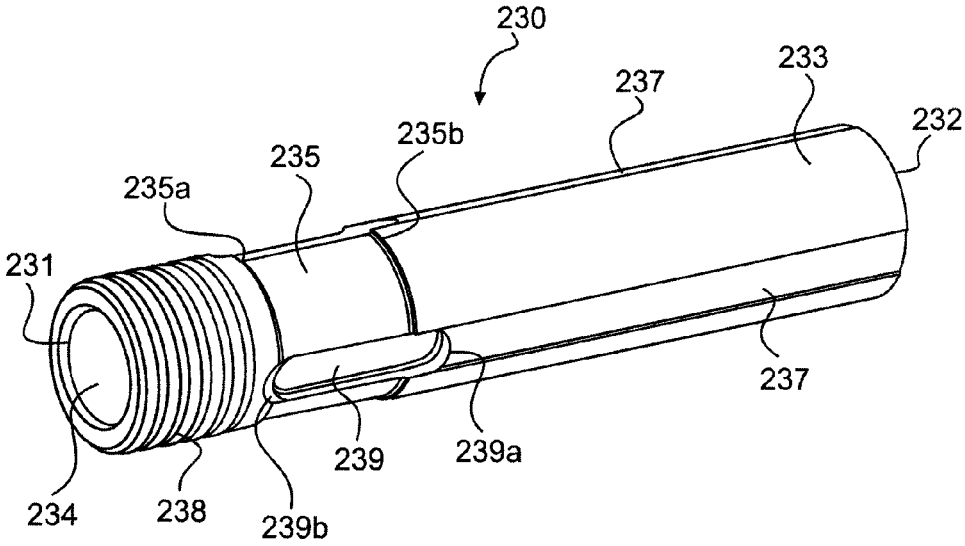
FIG. 5 is a rear perspective view of an embodiment of the piston.
Figure 6:
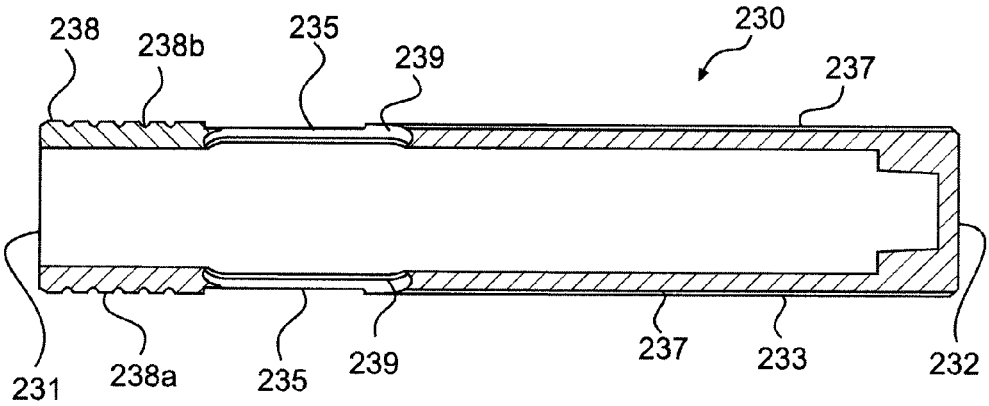
FIG. 6 is a side cross-sectional view of the piston of FIG. 5.

Turning to FIGS. 5 and 6 for a more detailed view of the gas piston, the gas piston 230 also generally comprises a cylindrical body having an open tubular first end 231, a closed head or second end 232, and a substantially smooth outer surface 233. As will be appreciated by those skilled in the art, the outside diameter of the piston 230 approximates the diameter of the inner bore 214 of the gas expansion housing 210, taking into consideration such factors as mechanical tolerances, anticipated operating conditions, friction, mechanical efficiency, etc. An inner bore or chamber 234 is defined within the piston body and extends longitudinally therealong from the open tubular end 231 to the head 232. The inner bore 234 is dimensioned to receive a spring-loaded connecting rod 250 and a piston spring 251 therein, as illustrated in FIGS. 2-4. During operation, an actuator block 252 is provided within the inner bore 234 to engage the piston spring 251.

As shown in FIGS. 5 and 6, an annular recess 235 is formed in the outer surface 233 of the gas piston 230. This annular recess 235 generally extends around substantially the entire circumference of the outer surface 233 of the piston 230 in the embodiments shown, and extends axially (longitudinally) a selected distance defined by front or upstream and rear or downstream edges 235*a*, 235*b*. The annular recess is dimensioned and located as an initial receptor for the redirected exhaust gases that are diverted from the barrel 130 proximate the chamber 122 of the rifle 100 through the gas port 218 during firing. The annular recess 235 thus helps facilitate the distribution of the expanding exhaust gases around the entire circumference of the gas piston 230.

Figure 7:
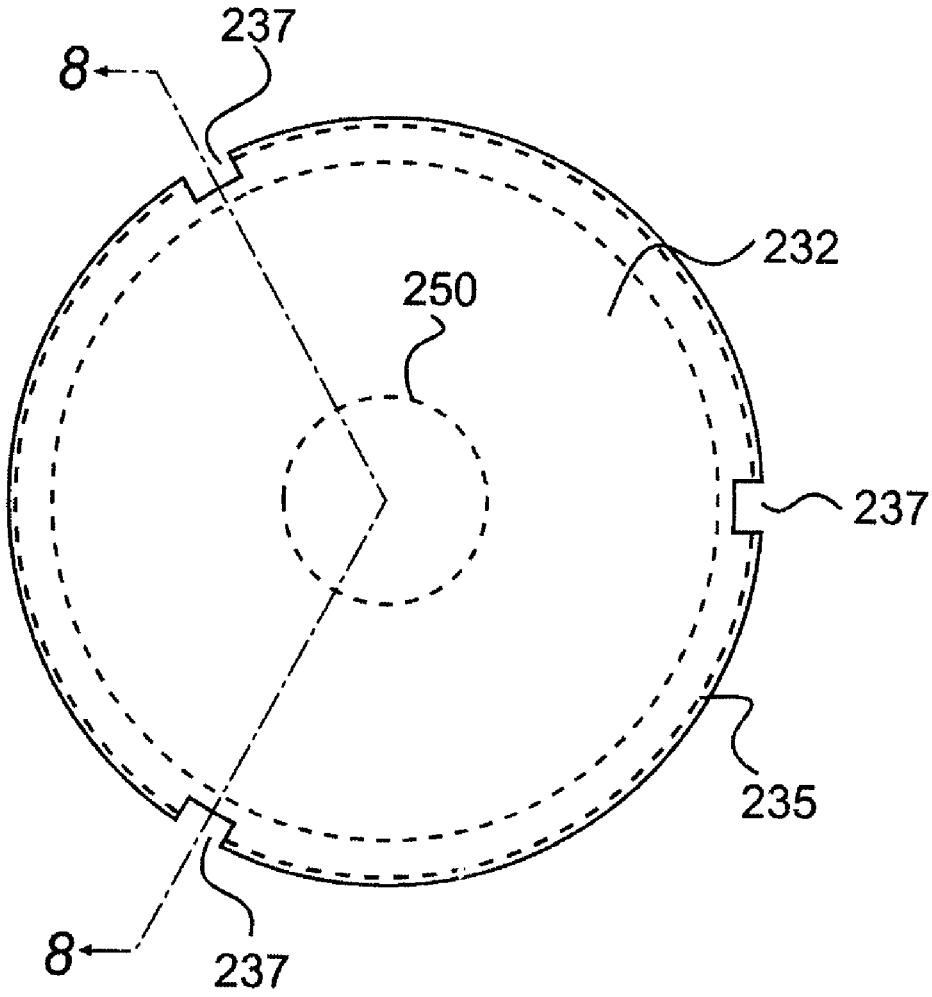
FIG. 7 is an end view of the piston of FIG. 5.

As shown in FIG. 5, at least one longitudinally extending groove or slit 237 typically is formed in the outer surface of the piston and extends approximately from the front edge 235*b* of the annular recess 235 to the forward, second end, or head 232 of the piston 230. The groove 237 generally creates a pathway for the exhaust gas from the annular recess 235 to the head 232 of the gas piston 230. In the embodiment shown in FIGS. 5 through 7, three longitudinally extending grooves 237 are formed in the outer cylindrical surface 233, although fewer or more grooves can be provided as needed or desired. For example, it may be desirable to provide multiple, equally-spaced apart grooves to provide enhanced channeling of a sufficient volume of expanding gas to the closed head 232 of the gas piston for proper actuation; and/or to help maintain symmetry and center of gravity for the piston 230 during the firing cycle. As will be also appreciated, the number and relative dimensions (width and depth) of the grooves 237 is not critical to the piston 230 of the present invention as long as the desired operational characteristics of the gas piston assembly 200 are achieved.

In addition, an annular turbulent gas seal 238 generally formed from a flexible sealing material typically can be mounted about the entire circumference of its piston proximate the open tubular end 231 thereof. The annular gas seal 238 is shown in the illustrated embodiment as comprising a series of spaced, parallel ridges 238*a* and grooves 238*b* to create a mechanically efficient piston seal in a manner understood in the fluid arts. It will also be understood that additional, alternative seals can be used, including flexible, compressible synthetic or plastomeric seals, mounted within or adjacent the ridges and grooves.

As shown in FIGS. 5 and 6, at least one elongate axial slot 239 also is formed in the outer surface 233 of the gas piston 230. As will be described in greater detail below, the elongate axial slot 239 may extend from a point 239*a* located forwardly of the front edge 235*a* of the shallow annular recess 235 to a point 239*b* located rearwardly of the rear edge 235*b* of the annular recess 235. In one embodiment, the elongate slot 239 is approximately co-linear with at least one longitudinally extending groove 237 and extends to a depth greater than the depth of both the annular recess 235 and the longitudinally extending groove 237. In the particular embodiment shown in FIGS. 5 and 6, the piston 230 includes three elongate axial slots 239, corresponding to the number of longitudinally extending grooves 237, although fewer or more slots can be provided as needed. The locating of the rear edge or point 239*b* of each of the slots 239 rearwardly of the rear edge 235*b* of the recess 235, in conjunction with the rear end 213 of the housing 210, helps provide an opening or purge area for the excess exhaust gases when the piston 230 is at its full stroke as shown in FIG. 8B. Additionally, a stop, or boss, 241 extends through the wall 212 of the housing 210 to cooperatively engage one of the elongate axial slots 239 and thus helps control or limit the rearward and forward travel of the piston 230 during actuation.

The installation and operation of the gas-operated piston assembly 200 according to the principles of the present invention is best illustrated by reference to the cross sectional views of FIGS. 3 and 4, and the schematic illustrations of FIGS. 8A and 8B. In the initial firing position, the piston 230 is seated in its forwardly extended first or rear position along the gas expansion housing 210 in preparation for firing. The spring 251 maintains a compressive pressure on the piston 230 through the inner bore of the piston by way of the actuator block 252. Upon firing, the explosive force of the propellant in the chamber 122 of the firearm 100 creates exhaust gases which rapidly expand and travel outwardly from the chamber, into the barrel region, ultimately discharging through the muzzle.

In some prior art devices, the gas port for directing the exhaust gases from firing, typically is located substantially downstream along the barrel to divert some portion of the expanding gases substantially directly against the head of a gas piston or piston chamber. It has been found by the inventor, however, that greater energy or force from such exhaust gases may be directed to the piston when the expanding exhaust gases are captured and diverted to the piston as closely as possible to the chamber region of the rifle. In the chamber region, the gases from the exploding propellant are still expanding at rapid rate, whereas the further downstream in the barrel the gases are diverted, the less energy may be captured as the expansion rate diminishes significantly along the barrel length. Further, positioning the gas port as closely as possible to the chamber helps ensure a longer impulse (in terms of time), delivered by the expanding gases, for driving the piston 230.

More particularly, it has been found that the "burn" of the propellant from a cartridge occurs in phases. The closer the gas port 132 is to the chamber, the more likely that incompletely burned residue will be deposited on the piston 230 and within the housing 210. This results from the progressive nature of the burning of the powder as in an initial phase, when combustion/explosion is still occurring. Thus, the inventors have discovered that gas port 132 locations for the embodiments described herein are optimal at a point where a balance may be achieved between a sufficient dynamic energy level available to the piston and a satisfactory level of burn of the propellant. It has therefore been found that for the variety of anticipated ammunition types, comprising different types and amounts of propellants, the gas port is desirably located at a position wherein between about seventy percent and about eighty percent of the propellant contained in the cartridge/shell being fired generally will have been burned. For the embodiments described herein, this corresponds to a gas port location of generally between about two inches and about eight inches from the upstream or rear end of the chamber, although it will be understood that further variations in this location can be utilized as needed depending on cartridge/shell length, and other factors.

It has additionally been found that the configuration and location of the gas redirecting piston assembly 200 according to the principles of the present invention enables the higher pressure, rapidly expanding gases from firing to be diverted at a reduced, substantially optimal distance from the chamber and channeled to the piston head. Thus, the exhaust gases may be diverted, or rather, redirected upstream so as to be controllably applied to the head of the piston through the recesses and longitudinal grooves described herein.

Figure 8A:
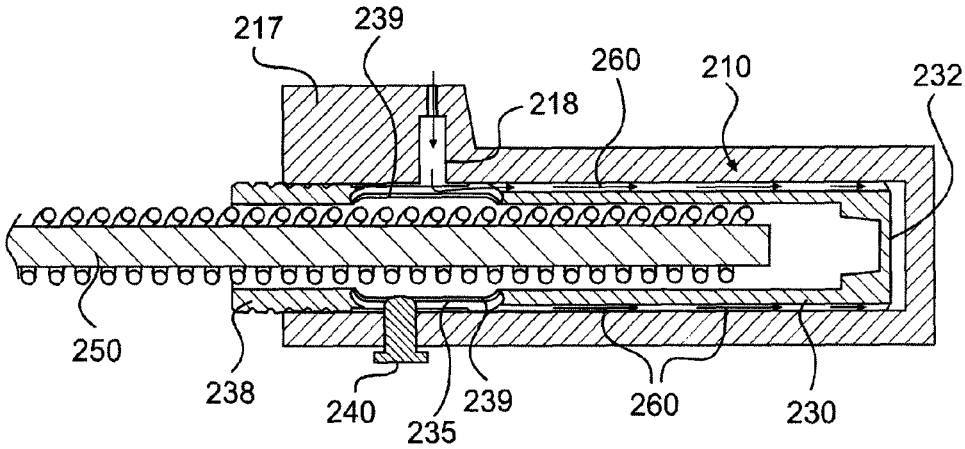
FIGS. 8A and 8B are schematic illustrations showing the action of the gas on the piston during the firing cycle.
Figure 8B:
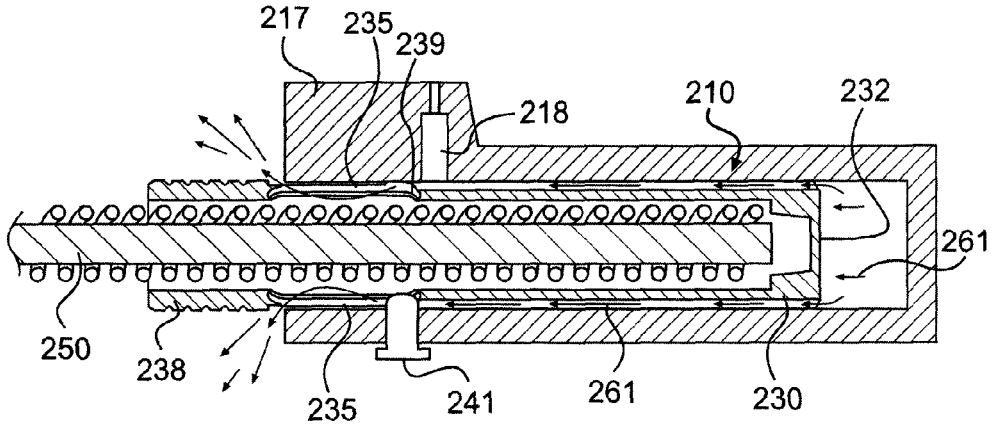

As shown in FIGS. 3 and 8A, at the beginning of the firing cycle, the expanding propellant gases are diverted through the gas duct 132 and through the gas port 218 into the gas expansion housing 210 proximate the annular recess 235. The gas seal 238 seals against the housing as the pressurized gases enter the annular recess 235, and accordingly blocks the passage of the gases along the housing in a rearward direction. As a result, as indicated in FIG. 8A, as the expanding gases fill the annular recess 235, they are forced longitudinally forward to the head 232 of the piston 230 in the direction of arrows 260. The force of the expanding gases acting against the head 232 of the piston 230 drives the piston rearwardly, as indicated by arrows 261 in FIG. 8B, causing the actuator block 252 to engage and overcome the force of the spring 251. This then causes the bolt/breech bolt 122 to be translated rearwardly along the receiver 120, wherein the spent cartridge casing is ejected and a new cartridge "chambered."

At this point in the firing cycle, the relative position of the piston 230 is as shown in FIGS. 4 and 8B. The gas seal 238 now projects outwardly from the end of the housing 210 and the rearward travel of the piston 230 is limited by the boss, or stop, 241 abutting the forward edge 239*a* of the elongate axial slot 239. As illustrated schematically in FIG. 8B, the location of the gas port 218, in combination with the location and relative dimensions of the stop 241, annular recess 235, and elongate axial slot 239 enable two additional aspects of this embodiment of the gas piston assembly 200 to function. First, as shown in the Figures, the rearward movement of the piston 230 generally limits the flow of expanding gases through the port 218 and into the housing, and therefore into the annual recess 235, by virtue of the outer surface of the piston slidingly blocking or moving in front of the outlet of the port 218. Further, the rear edges 239*b* of the one or more elongate axial slots 239 are formed to extend slightly beyond the open end 213 of the housing 210, thus creating one or more purge vents for the evacuation of the propellant gases from the housing 210 (shown by the arrows). This release of the trapped exhaust gases effectively limits the damping that the piston will experience upon return to its original position within the housing 210. Thus, the piston may smoothly retract to its starting position of FIG. 3, completing one firing cycle.

Figure 9:
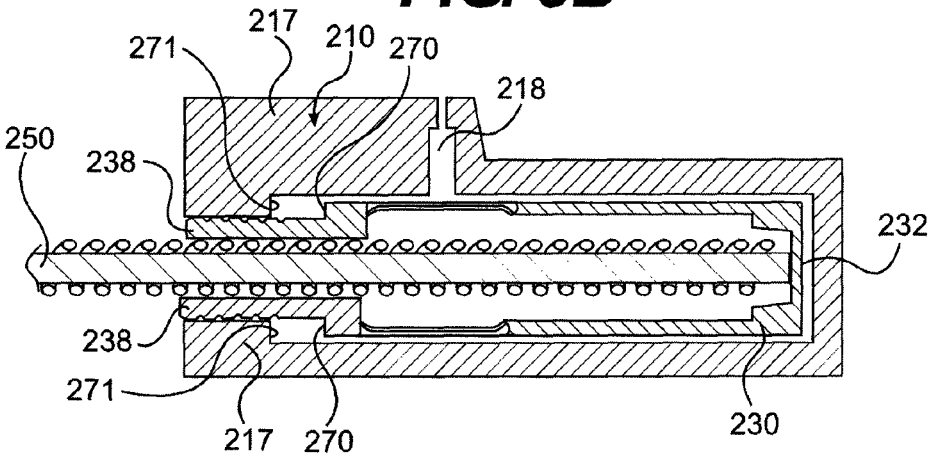
FIG. 9 is a side cross-sectional view of a portion of the gas expansion housing and piston, illustration a stop feature on the piston.

As additionally shown in FIG. 9, the piston 230 further can be configured so as to define a stop portion or edge 270 along the rearward or second end thereof, adjacent the gas seal 238. The gas expansion housing 210 similarly can be configured to provide a bearing surface or stop 271 against which stop or edge 270 of the piston 230 will engage as the piston reaches the desired limit or full extent of its rearward travel in operation. The stop 270 and bearing surface 271 can be defined so as to limit the travel of the piston along the housing to a desired amount and to prevent overtravel of the piston to a point where its return stroke or movement could be impaired.

It therefore can be seen that the construction of the gas redirecting piston assembly according to the principles of the present invention addresses the problems inherent in the prior art constructions of gas-operated firearms. For example, the gas redirecting piston assembly of the present invention can enable the gas port(s), or duct(s), which divert the expanding propellant gases from the barrel, to be situated closer to the chamber of the firearm. This provides the ability to recoup greater energy/work from the higher pressure of the expanding gases for any given barrel length. Further, there is a more efficient use of the expanding propellant gases by directing the gases along narrow grooves on the piston before too much gas expansion occurs within the barrel.

The corresponding structures, materials, acts and equivalents of any means plus function elements in any of the claims below are intended to include any structure, material, or acts for performing the function in combination with other claim elements as specifically claimed.

Those skilled in the art will appreciate that many modifications to the exemplary embodiments are possible without departing from the spirit and scope of the present invention. In addition, it is possible to use some of the features of the present invention without the corresponding use of the other features. Accordingly, the foregoing description of the exemplary embodiments is provided for the purpose of illustrating the principles of the present invention and not in limitation thereof since the scope of the present invention is defined by the appended claims.

What is claimed is:

1. A gas redirecting piston assembly for a gas-operated firearm of the type having a chamber and a barrel, the gas redirecting piston assembly comprising:

a gas expansion housing defining an inner bore and having a gas port extending therethrough and into communication with the barrel of the firearm;

a piston slideably received within the inner bore of the gas expansion housing, and having a first end, a second end, a substantially cylindrical outer wall, defining a chamber dimensioned to receive a spring-loaded connecting rod, an annular recess of a selected depth formed about at least a portion of a circumference of the outer wall of the piston at a location proximate the first end of the piston, and at least one longitudinally extending groove formed in the outer wall of the piston, in communication with and extending along the outer wall of the piston approximately from the annular recess to the second end of the piston for forming a pathway for redirecting the portion of gases from firing along the outer wall of the piston and along the bore of the gas expansion housing from the gas port thereof into engagement with the second end of the piston;

wherein during operation, a flow of pressurized gases generated from firing are diverted through the gas port and are received within the annular recess of the piston, which redirects the pressurized gases along the at least one longitudinally extending groove formed in the outer wall of the piston of the piston, whereupon the pressurized gases expand along the at least one longitudinally extending groove and are redirected against the second end of the piston so as to drive the piston axially from a first, retracted position within the housing to a second, extended position.

2. The gas redirecting piston assembly of claim 1 wherein the piston comprises a plurality of longitudinally extending grooves, arranged in spaced series about the outer wall of the piston.

3. The gas redirecting piston assembly of claim 2 wherein the piston comprises three similarly formed and dimensioned longitudinally extending grooves.

4. The gas redirecting piston assembly of claim 1 and further comprising:

(a) at least one slot formed in the outer wall of the piston; and (b) a stop extending through the gas expansion housing into the slot.

5. The gas redirecting piston assembly of claim 4 wherein:

(a) the annular recess comprises a front edge, a rear edge, and a cylindrical surface; and (b) the at least one slot extends along the cylindrical surface of the annular recess from a point forward of the front edge of the annular recess to a point rearward of the rear edge of the annular recess.

6. The gas redirecting piston assembly of claim 1 further comprising an annular gas seal proximate the first end of the piston.

7. The gas redirecting piston assembly of claim 6 wherein the annular gas seal comprises a tubular member having a series of spaced annular ridges and grooves formed thereabout.

8. The gas redirecting piston assembly of claim 1 wherein when the piston is in its extended position, the outer cylindrical wall of the piston at least partially blocks the flow of gases from the gas port into the gas expansion housing.

9. The gas redirecting piston assembly of claim 1 further comprising at least one slot formed proximate the first end of the piston and in communication with the annular recess, wherein when the piston is in the its extended position, the at least one slot extends outwardly from the housing to provide a gas vent for the gas expansion housing.

10. A gas-operated firearm for automatically loading a next round of ammunition after firing, comprising:

a bolt;

a chamber section;

a barrel;

a gas expansion housing defining an inner bore and a gas port extending through the expansion housing and communicating with the inner bore of the gas expansion housing and the barrel;

a gas duct located adjacent the chamber section and extending between the barrel and the gas port of the gas expansion housing;

a piston slideably received within the inner bore of the gas expansion housing, the piston comprising:

an outer wall;

a first end, a second end spaced from the first end, and an inner bore extending between the first and second ends;

a connecting rod received within the inner bore;

an annular recess formed along the outer wall of the piston proximate the first end thereof and adapted to receive exhaust gas diverted from the barrel upon firing through the gas duct and gas port;

at least one longitudinally extending groove formed in the outer wall of the piston, in communication with and extending from the annular recess of the piston along the outer wall of the piston to the second end of the piston for directing the exhaust gas from the annular recess to a point between an end of the gas expansion housing and the second end of the piston so as to be redirected against the second end of the piston; and wherein pressurized exhaust gas is diverted from the barrel via the gas duct, through the gas port of the gas expansion housing and into the annular recess, whereupon the exhaust gas is enabled to expand longitudinally as it flows along the at least one longitudinally extending groove of the piston to the second end of the piston, whereupon the pressurized exhaust gas is directed against the second end of the piston and urges the piston axially along the expansion housing from a first position to a second, extended position for cycling the bolt of the firearm to load the next round of ammunition in the chamber of the firearm.

11. The firearm of claim 10 wherein the at least one longitudinally extending groove comprises a plurality of similarly formed longitudinally extending grooves spaced about the outer wall of the piston.

12. The firearm of claim 10 wherein the at least one longitudinally extending groove comprises three similarly formed and dimensioned grooves.

13. The firearm of claim 10 and further comprising:

(a) at least one slot formed in the outer wall of the piston; and (b) a stop extending into the slot.

14. The firearm of claim 13 wherein:

(a) the annular recess comprises a front edge, a rear edge, and a cylindrical surface; and (b) the at least one slot extends along the cylindrical surface of the annular recess from a point forward of the front edge of the annular recess to a point rearward of the rear edge of the annular recess.

15. The firearm of claim 10 further comprising an annular gas seal proximate the first end of the piston.

16. The firearm of claim 15 wherein the annular gas seal comprises a tubular member having a series of spaced annular ridges and grooves formed thereabout.

17. The firearm of claim 16 wherein when the piston is in its extended position, the outer cylindrical wall of the piston substantially restricts a flow of the exhaust gas from the gas port into the inner bore of the gas expansion housing.

18. The firearm of claim 10 further comprising at least one slot formed proximate the first open end of the piston and in communication with the annular recess, wherein when the piston is moved to its extended position, the at least one slot extends outwardly from the housing to define a vent for escape of the exhaust gas from the expansion housing.

19. The firearm of claim 10 and wherein said piston comprises a stop defined adjacent the first end of the piston and adapted to engage a corresponding bearing surface of the gas expansion housing to limit the axial movement of the piston rearwardly along the gas expansion housing.

20. A gas-operated firearm for automatically loading a next round of ammunition after firing, comprising:

a barrel having a chamber section adjacent a proximal end thereof;

a gas expansion housing mounted adjacent the barrel and including a first end, a second end, an inner bore extending between the first and second ends, and a gas port extending through the expansion housing and communicating with the inner bore of the gas expansion housing and the barrel;

a gas duct located between approximately 2 inches and approximately 8 inches from an upstream end of the chamber section of the barrel, extending between the barrel and the gas port of the gas expansion housing;

a piston slideably received within the inner bore of the gas expansion housing, the piston comprising:

an outer wall;

a first end, a closed second end spaced from the first end, and an inner bore extending partially along the piston from the first end toward the second end;

a connecting rod received within the inner bore;

an annular recess formed in the outer wall of the piston proximate the first end thereof and extending about at least a portion of a circumference of the piston, the annular recess dimensioned and adapted to receive pressurized exhaust gases diverted from the barrel after firing through the gas duct and gas port;

at least one longitudinally extending groove formed in the outer wall of the piston, in communication with and extending from the annular recess of the piston along the outer wall of the piston to the closed second end of the piston for redirecting the exhaust gases from the annular recess to a point between the second end of the gas expansion housing and the closed second end of the piston so as to be redirected against the closed second end of the piston; and wherein pressurized exhaust gases are diverted from the barrel via the gas duct, through the gas port of the gas expansion housing and into the annular recess, whereupon the pressurized exhaust gases are enabled to expand longitudinally as the pressurized exhaust gases flow forwardly along the at least one longitudinally extending groove of the piston to the closed second end of the piston, whereupon the pressurized exhaust gases are redirected against the closed second end of the piston so as to urge the piston axially rearwardly along the expansion housing from a first position to a second, extended position for cycling the bolt of the firearm to load the next round of ammunition in the chamber of the firearm.

* * * * *